United States Patent [19]

Lavine et al.

[11] Patent Number: 4,457,571

[45] Date of Patent: Jul. 3, 1984

[54] RETAINER APPARATUS FOR ELECTRIC PLUGS

[76] Inventors: Daniel J. Lavine; Mary A. Lavine, both of 1162 Center St., Middleboro, Mass. 02346

[21] Appl. No.: 292,838

[22] Filed: Aug. 14, 1981

[51] Int. Cl.[3] ..... H01R 13/44; H01R 13/62

[52] U.S. Cl. ..... 339/75 P; 339/89 R

[58] Field of Search ..... 339/39, 75 P, 82, 88, 339/89, 206–208

[56] References Cited

U.S. PATENT DOCUMENTS

| | | | |
|---|---|---|---|
| 2,378,105 | 6/1945 | Roesch | 339/75 P |
| 2,659,059 | 11/1953 | Johnson | 339/75 P |
| 2,716,225 | 8/1955 | McCubbin | 339/75 P |
| 2,743,425 | 4/1959 | Perrault et al. | 339/75 P |
| 3,005,176 | 10/1961 | Berg | 339/75 P |
| 3,123,423 | 3/1964 | Schmitt | 339/DIG. 2 |
| 3,428,936 | 2/1969 | Arnas | 339/39 |
| 3,601,757 | 8/1971 | Gober | 339/75 P |
| 3,871,731 | 3/1975 | LaCoursiere et al. | 339/75 P |
| 4,045,108 | 8/1977 | Olsen | 339/75 P |
| 4,105,274 | 8/1978 | Casey | 339/75 P |
| 4,219,693 | 8/1980 | French | 339/39 |

*Primary Examiner*—John McQuade
*Assistant Examiner*—Paula Austin
*Attorney, Agent, or Firm*—John A. Haug

[57] ABSTRACT

The plug of an electrical cord is retained in a receptacle by a two piece housing which snaps together about the plug. The housing has a pair of projecting tabs which interfit with a guide rail formed integrally with the cover plate or escutcheon which fits over the receptacle. The tabs have a protrusion projecting therefrom which is received in a recess formed in the guide rail to lock the housing to the escutcheon.

9 Claims, 7 Drawing Figures

RETAINER APPARATUS FOR ELECTRIC PLUGS

BACKGROUND OF INVENTION

This invention relates to electrical plugs and particularly to apparatus for retaining such plugs in their mounted position in electrical receptacles.

In many, if not most cases, electrically operated equipment including lights, radios, televisions, kitchen appliances and the like, are connected to an electrical distribution system by inserting a male plug on the free distal end of a cord attached to the equipment into a wall or floor mounted female receptacle in such a way that the plug can be removed merely by pulling on it. This has resulted in many accidents, some of a serious nature, particularly when young children have access to the plugs. The plugs are in effect an attractive nuisance with children who tend to play with them, prodding them with their fingers and other small objects in such a way that they can make contact with a live electrical circuit by touching the prongs of the plug while it is still in electrical connection with the receptacle.

Over the years attempts have been made to provide devices to lock such plugs in their respective receptacles; however, none has been widely accepted in the market place due to various reasons such as the inconvenience involved in using certain devices which were too complicated for the average consumer, or they involved using supplemental tools such as screw drivers with which the consumer did not wish to bother, or they were too expensive to be affordable to the average consumer or they were too unattractive to appeal to consumers.

SUMMARY OF THE PRESENT INVENTION

It is therefore an object of the present invention to provide a simple yet reliable apparatus to retain electrical plugs in their mating receptacles. Another object is the provision of such apparatus which is inexpensive and attractive, usable with plugs with or without ground conductors. Yet another object is the provision of plug retainer apparatus which requires no supplemental tools for locking a plug to its receptacle.

Various and other objects and advantages will appear from the following description of one embodiment of the invention, and the novel features will be particularly pointed out hereinafter in connection with the appended CLAIMS.

Briefly, in accordance with the invention a generally tubular two part housing of electrically insulative material has a first open end from which projects a pair of outwardly, radially extending tabs. A second end of the housing is closed except for a cord receiving aperture. The two housing parts are identical, a part having a hooked tongue projecting from the cylindrical wall which interfits with and snaps into an aperture in the cylindrical wall of another part placed in face to face relation therewith. An electrically insulative escutcheon or cover plate having a selected number of receptacle apertures therein is provided with a pair of guide rails for each aperture, formed integrally with the escutcheon. The aperture is disposed intermediate the two guide rails of its respective pair. The guide rails are each provided with a retainer surface spaced above the bottom wall of the escutcheon, and a detent groove portion in each retainer surface, the groove extending laterally across the guide rail. A protrusion is formed in each tab which is receivable in a retainer surface groove. When the escutcheons have a plurality of receptacle apertures the guide rails of each pair are preferably offset angularly a slight amount to provide sufficient clearance between the receptacles to facilitate mounting of a retainer housing without interference from an adjacent retainer housing.

BRIEF DESCRIPTION OF THE DRAWINGS

The invention is illustrated in the accompanying drawings wherein.

and

Figure 7:
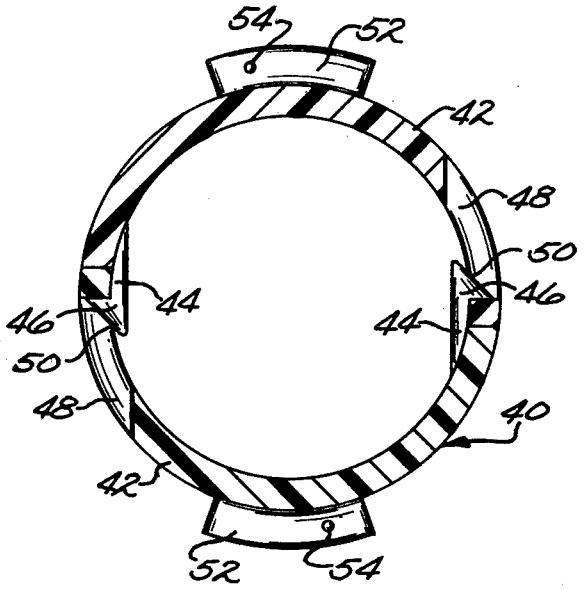
Figure 6:
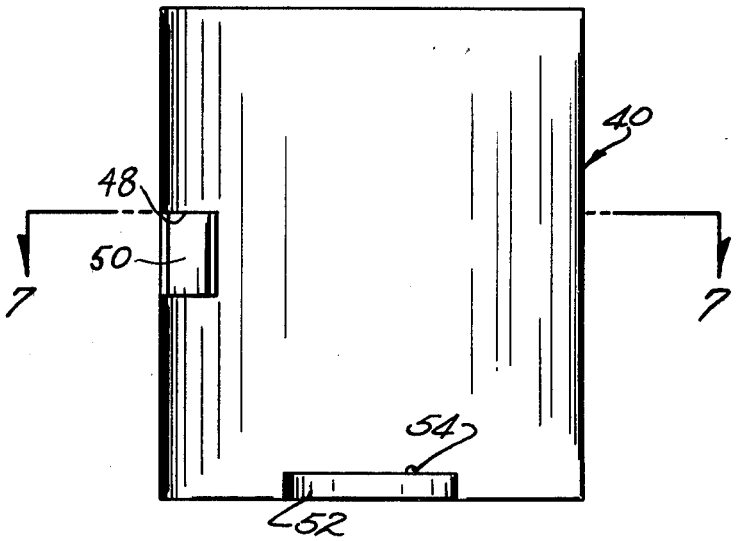
FIG. 6 is a front elevational view of a retainer housing.

FIG. 7 is a cross sectional view taken through lines 7—7 of FIG. 6.

DETAILED DESCRIPTION OF THE ILLUSTRATED EMBODIMENT

Figure 1:
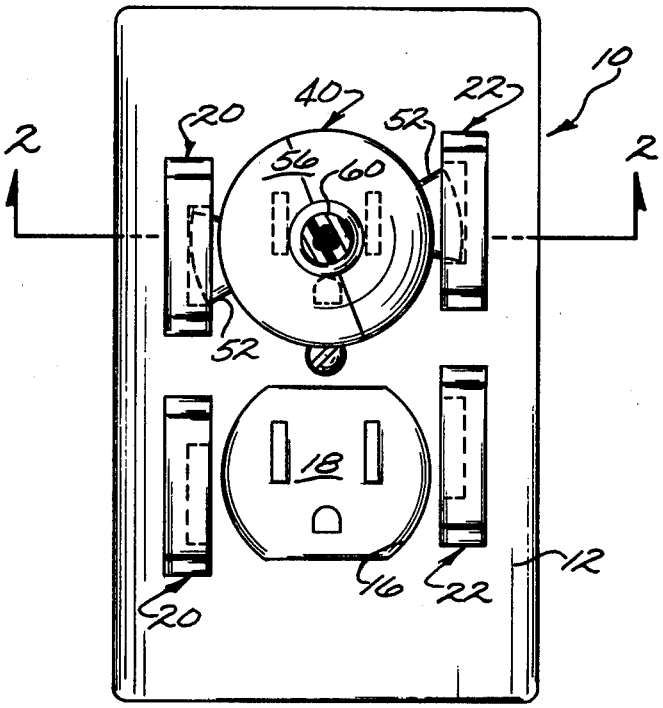
FIG. 1 is a top plan view of an escutcheon made in accordance with the invention having two receptacle apertures, the escutcheon mounted over a pair of receptacles with one having a plug retainer housing in locked position.

Referring now to the drawings wherein like reference numerals refer to like and corresponding parts throughout the several views, a safety plug retainer 10 made in accordance with the invention comprises an escutcheon 12 formed of conventional electrically insulating material such as Noryl PX-1408 and is formed with conventional plug receiving apertures 14, 16 disposed on the same vertical axis adapted to be received over female receptacles such as receptacle 18 shown in FIG. 1.

Escutcheon 12 is formed with a pair of tab receiving rails 20, 22 for each plug receiving aperture 14, 16. Rails 20, 22 are disposed on opposite sides of their respective apertures and are displaced slightly from a facing relationship with one another for a reason which will be explained below. As shown in FIG. 1 rails 20, 22 are displaced approximately 15° in a counterclockwise direction.

Rails 20, 22 comprise boss like elements having a recessed channel area 24, 26 respectively having respective top rail surfaces 28, 30. The boss like elements project upwardly from the escutcheon bottom wall and have a back wall, two side walls, a top wall and a generally flat front wall facing the respective aperture and parallel to the vertical axis. The recessed channel areas are formed in the front wall and are effectively closed by the back and side walls. A detent groove 32 is formed in rail surface 28 and a similar detent groove 34 is formed in rail surface 30. Detent grooves 32, 34 are located on the same axis which also is the horizontal axis for their apertures 14, 16. A stop surface 36 is disposed in channel 24 while a similar stop surface 38 is disposed in channel 26.

With particular reference to FIGS. 6 and 7, a tubular plug receiving housing 40 is conveniently made of two essentially identical half elements 42 formed of electrically insulative material which can be the same as that used for escutcheon 12. Essentially the halves are formed by a plane cutting through the housing with the longitudinal axis of the cylindrical or tubular housing lying in the plane. Each element 42 is provided with a tongue 44 having a hasp 46 formed adjacent its free distal end. Element 42 is also provided with an aperture 48 which is in alignment with the tongue of a corresponding element when two elements 42 are placed in facing relationship or, in other words, aligned with the mirror image portion of the tongue. When elements 42 are placed together, tongue 44 of one element 42 fits into aperture 48 of the other element 42 with hasp cammed inwardly via inclined surface portion 50 by the wall of element 42 during insertion with hasp 46 received in aperture 48 to lock the two elements 42 together. In order to eliminate any possible skewing or twisting tendency of one half relative to the other it may be desired to provide one or more protrusions on the surface cut by the plane with matching recesses so that each protrusion of one half will be received in a recess in the half.

A radially outwardly extending flange or tab 52 projects from the side wall at one end of each half element 42 and is provided with a projection 54. At the other end of each element 42 is a top wall 56 with a cut out portion 58 to permit passage of an electric cord 60 therethrough (FIG. 2)

Figure 2:
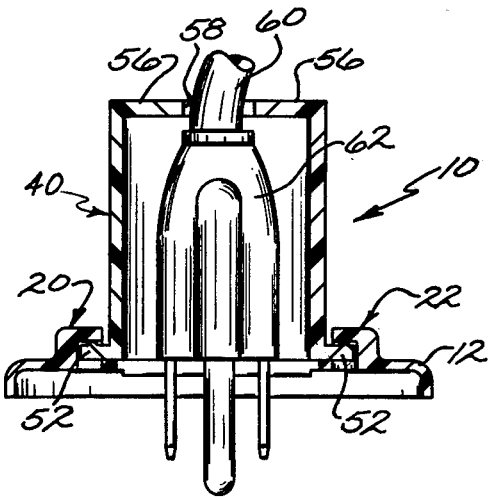
FIG. 2 is a cross sectional view taken on lines 2—2 of FIG. 1.
Figure 3:
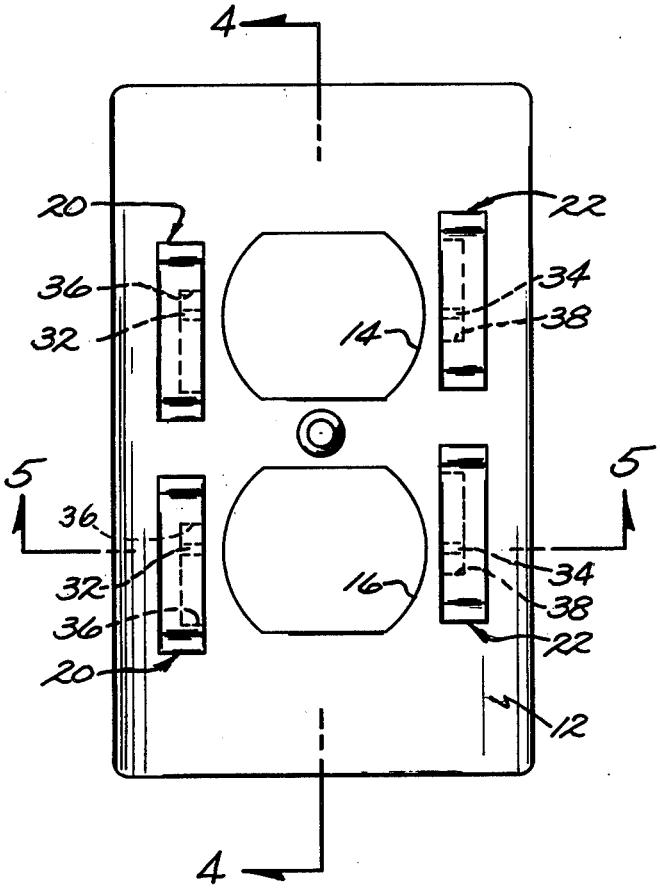
FIG. 3 is a top plan view similar to FIG. 1 but showing the escutcheon without any plugs or receptacles.
Figure 4:
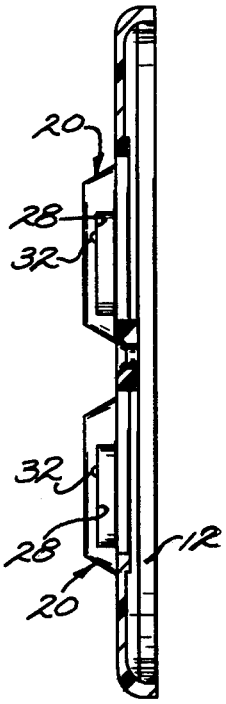
FIG. 4 is a cross sectional view taken on lines 4—4 of FIG. 3.
Figure 5:
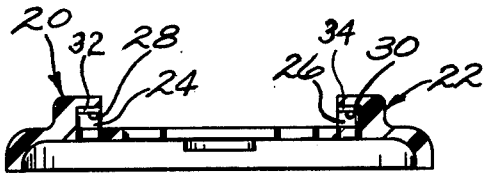
FIG. 5 is a cross sectional view taken on lines 5—5 of FIG. 3.

As seen in FIG. 2 an electrical cord plug 62 is locked in its receptacle by means of tabs 52 of housing 40 cooperating with guide rails 20, 22. Two half elements 42 are locked together about a cord 60. The plug is placed into the receptacle, housing 40 is then axially moved toward and surrounds the plug with tabs 52 disposed generally in vertical alignment. When the housing bottoms out against escutcheon 12 the housing 40 is rotated clockwise with tabs 52 moving into channels 24, 26 and projection 54 riding against a rail surface 28, 30 until the projection is received in detent groove 34, 36 to securely lock it in place.

The guide rails of pair 20 and 22, as mentioned supra, are angularly displaced slightly, that is in the order of 10° to provide suitable clearance between adjacent receptacles to facilitate placement of the retainer housing 40 contiguous to escutcheon 12 prior to rotation of the housing to lock the tabs beneath the guide rails. It will be understood that in embodiments wherein the escutcheons have but a single receptacle aperture it may be preferred not to displace the guide rails.

Thus in accordance with the invention an extremely simple device is provided, comprising a two part housing which snaps together about an electrical cord and is placed over a plug which has been inserted into a receptacle. The housing is then placed in contact with the escutcheon, with the tabs disposed generally in vertical relation relative to the escutcheon and then this housing is rotated so that the tabs are inserted beneath the guide rail retainer surfaces until the protrusions on the tabs are received in the detent grooves to securely lock the housing to the escutcheon. Thus an electric plug is locked in place without the need of any supplemental tools or the like. The plug can be conveniently removed by an adult rotating it in the opposite direction and, if it is desired to move the relevant applicance to another location, the housing can be used with any other escutcheon having similar guide rails.

It will be understood that various changes in the details, materials and arrangment of parts which have been herein described and illustrated in order to explain the nature of the invention, may be made by those silled in the art within the scope of the invention as expressed in the appended claims.

What is claimed is:

1. Electrical plug retainer apparatus comprising a generally tubular housing having first and second ends, tab means including two tabs extending radially outwardly in opposite directions from the housing adjacent the first end, a plug retaining wall at the second end with a cut out portion therethrough to permit a cord to pass therethrough, an escutcheon having a bottom wall and having a receptacle aperture defined therethrough, the aperture having a horizontal and a vertical axis, guide rail means including a pair of boss like elements projecting upwardly from the bottom wall on opposite sides of the receptacle aperture, each element having a top wall, two side walls, a back wall and a generally flat front wall facing the aperture and parallel to the vertical axis, a recessed channel formed in the front wall having a top rail surface spaced above the bottom wall of the escutcheon, the channel closed by the side walls, the two channels being angularly displaced on opposite sides of the horizontal axis, the tab means being pivotably movable to a position beneath the top rail surface to lock the housing to the escutcheon, a projection extending from a surface of each tab and a detent groove formed in the top rail surface of each top rail, the detent groove adapted to receive a respective projection therein.

2. Electrical plug retainer apparatus according to claim 1 in which the escutcheon is provided with at least two receptacle apertures, each receptacle aperture being provided with guide rail means.

3. Plug retainer apparatus comprising a plug retainer housing having a wall with a cord receiving aperture extending therethrough, tab means including two tabs extending outwardly from the housing, an escutcheon having a bottom wall and having a receptacle aperture defined therein, the aperture having a horizontal and a vertical axis, guide rail means including a pair of boss like elements projecting upwardly from the bottom wall on opposite sides of the receptacle aperture, each element having a top wall, two side walls, a back wall and a generally flat front wall facing the aperture and parallel to the vertical axis, a recessed channel formed in the front wall having a top rail surface spaced above the bottom wall of the escutcheon, the channel closed by the side walls, the two channels being angularly displaced on opposite sides of the horizontal axis, one of a protrusion and a protrusion receiving recess formed on the tab means, the other of the protrusion and the protrusion receiving recess formed on one of the bottom wall and top rail surface, the tab means being insertable between the bottom wall and the top rail surface, the spacing between the top rail surface and the bottom wall being such relative to the thickness of the tab means that the tab means closely fit therein to lock the housing to the escutcheon with the protrusion received in the protrusion receiving recess.

4. Plug retainer apparatus according to claim 3 in which the housing has a generally cylindrical wall having a first open end and a second end with a wall extending thereacross having the cord receiving aperture extending therethrough, the housing formed in two generally identical halves being defined essentially by a plane in which the longitudinal axis of the cylinder lies, each half having an aperture extending through the cylindrical wall and having a tongue projecting from the cylindrical axis with a hasp disposed at the distal end of the tongue, the hasp of one half being adapted to be received in the aperture of the other half.

5. Plug retainer apparatus according to claim 4 in which each housing half has an outwardly, radially extending tab and the protrusion is formed on the tab.

6. Electrical plug retainer apparatus comprising a generally tubular housing having first and second ends, tab means including two tabs extending radially outwardly from the housing adjacent the first end, a plug retaining wall at the second end with a cut out portion therethrough to permit a cord to pass therethrough, an escutcheon having a bottom wall and having at least two receptacle apertures defined therethrough, the apertures both disposed on the same vertical axis and each having a horizontal axis, guide rail means formed on the escutcheon for each receptacle aperture, the guide rail means including a pair of boss like elements projecting upwardly from the bottom wall on opposite sides of each receptacle aperture, each element having a top wall, two side walls, a back wall and a generally flat front wall facing its respective aperture and parallel to the vertical axis, a recessed channel formed in the front wall of each element having a top rail surface spaced above the bottom wall of the escutcheon, the channel closed by the side walls, the two channels of each respective receptacle aperture being angularly displaced on opposite sides of the horizontal axis of their respective receptacle aperture, one of a pair of protrusions and a pair of protrusion receiving recesses formed on the tab means, the other of the pair of protrusions and the pair of protrusion receiving apertures formed on one of the bottom wall and top rail surface, the tab means being insertable between the bottom wall and the top rail surface, the spacing between the top rail surface and the bottom wall being such relative to the thickness of the tab means that the tab means closely fits therein to lock the housing to the escutcheon with the protrusions received in the protrusion receiving recesses.

7. Electrical plug retainer apparatus comprising a generally tubular housing having first and second ends, tab means including two tabs extending radially outwardly from the housing adjacent the first end, a plug retaining wall at the second end with a cut out portion therethrough to permit a cord to pass therethrough, an escutcheon having a bottom wall and having at least two receptacle apertures defined therethrough, the apertures both disposed on the same vertical axis and each having a horizontal axis, guide rail means formed on the escutcheon for each receptacle aperture, the guide rail means comprising a pair of boss like elements projecting upwardly from the bottom wall on opposite sides of their respective aperture, each element having a top wall, two side walls, a back wall and a generally flat front wall facing its respective aperture and parallel to the vertical axis, a recessed channel formed in the front wall of each element having a top rail surface space above the bottom wall of the escutcheon, the channel closed by the side walls, the two channels of each respective aperture being angularly displacd on opposite sides of the horizontal axis of their respective aperture, the tab means being insertable between the bottom wall and the top rail surfaces, the spacing between the top rail surfaces and the bottom wall being such relative to the thickness of the tab means that the tab means closely fits therein to lock the housing to the escutcheon.

8. Electrical plug retainer apparatus according to claim 7 in which the housing comprises two separate parts which lockingly interfit with one another.

9. Electrical plug retainer apparatus according to claim 8 in which the housing has a longitudinal axis and the parts are identical, each part formed essentially by a plane in which the longitudinal axis lies, cutting through the housing, a part having a tongue having a free distal end extending from one portion of the housing wal with a hasp formed at the free distal end and a tongue receiving aperture in another portion of the housing aligned with the mirror image position of the tongue.

* * * * *